United States Patent [19]

Dahowski

[11] Patent Number: 4,490,067

[45] Date of Patent: Dec. 25, 1984

[54] MODULAR DRAIN SYSTEM

[75] Inventor: Donald E. Dahowski, York, Pa.

[73] Assignee: Quaker Plastic Corporation, Mountville, Pa.

[21] Appl. No.: 331,842

[22] Filed: Dec. 17, 1981

[51] Int. Cl.[3] ..... E01F 5/00

[52] U.S. Cl. ..... 404/4; 404/65; 405/43

[58] Field of Search ..... 405/43, 51; 404/2, 3, 404/4, 47, 64, 65

[56] References Cited

U.S. PATENT DOCUMENTS

| | | | |
|---|---|---|---|
| 1,998,514 | 4/1935 | Miller | 404/4 |
| 3,156,490 | 11/1964 | Myll | 405/51 X |
| 3,426,658 | 2/1969 | Frederickson | 404/65 |
| 3,465,654 | 9/1969 | Fox | 404/4 |
| 3,625,011 | 12/1971 | Stevenson | 405/36 |
| 3,876,322 | 4/1975 | Deason | 404/2 |

*Primary Examiner*—David H. Corbin

[57] ABSTRACT

A below ground drain and conduit member to receive surface water which also functions as a expansion and contraction joint is provided. The member comprises a hollow longitudinal member having an integrally joined upper polygonal portion (14) of a relatively narrower transverse dimension and a cylindrical lower portion (12) which may be anchored to the subsoil or a substrate and accommodates within said lower portion a cylindrical pipe to carry away accumulated water. The structural components are particularly adapted to be soldered or welded to form a water tight drainage system.

The drain of the invention is adapted to be aligned and secured by attaching clips (80) which may be secured, such as by stakes driven into the subsoil, to prevent dislocation as concrete is poured around the drain.

Water to be drained enters openings (23) in the top side, i.e. the horizontal face (22) of the upper portion (14) and is carried away in the cylindrical lower portion (12) which is in open communication with the upper portion. A channel, or indentation (24) in the outer surface of the drain enhances the attachment, i.e. bonding of the drain in the surrounding concrete. Extensions (32) contiguous to the bottom of the drain, which mate with attachable securing clips (80) afford means to align and hold the drain during installation.

15 Claims, 20 Drawing Figures

FIG. 4
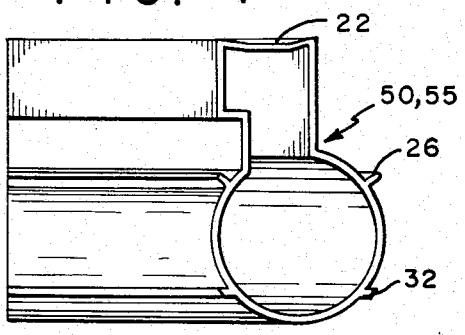
FIG. 5
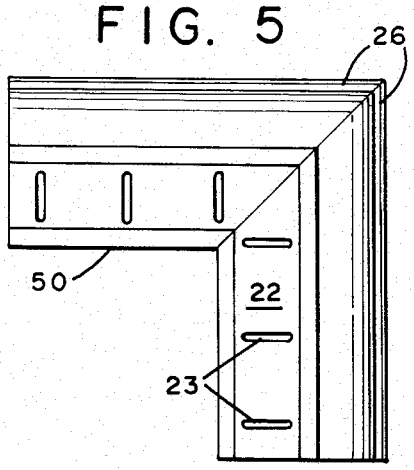
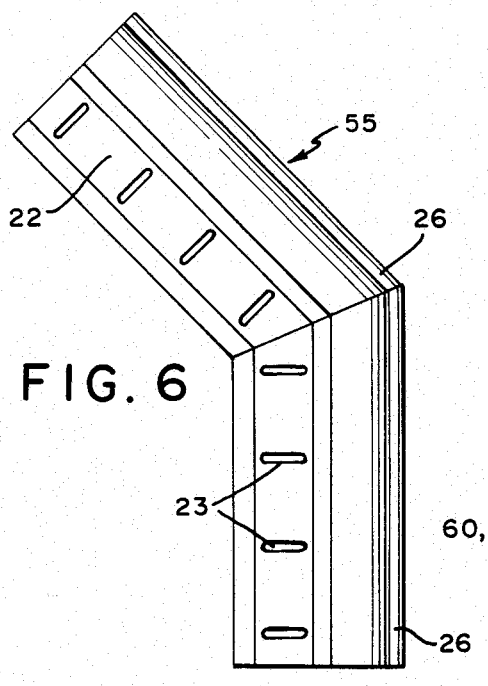
FIG. 6
FIG. 7
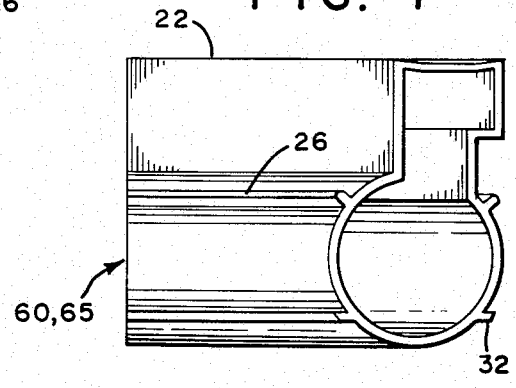
FIG. 8
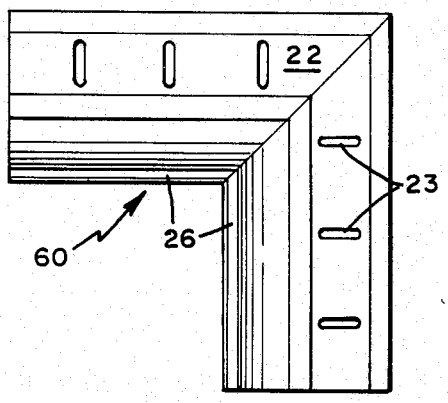

FIG. 9
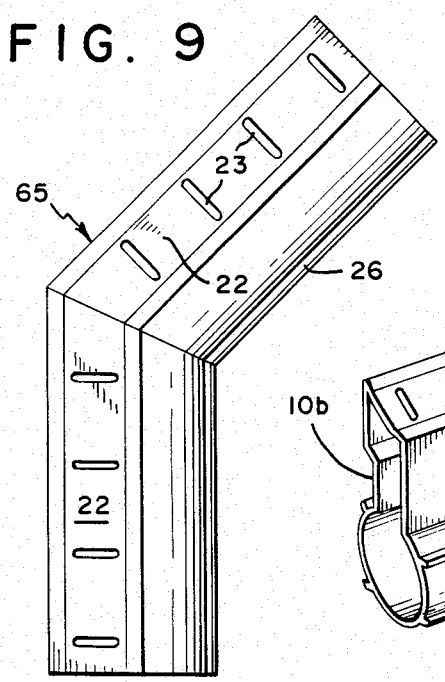
FIG. 10
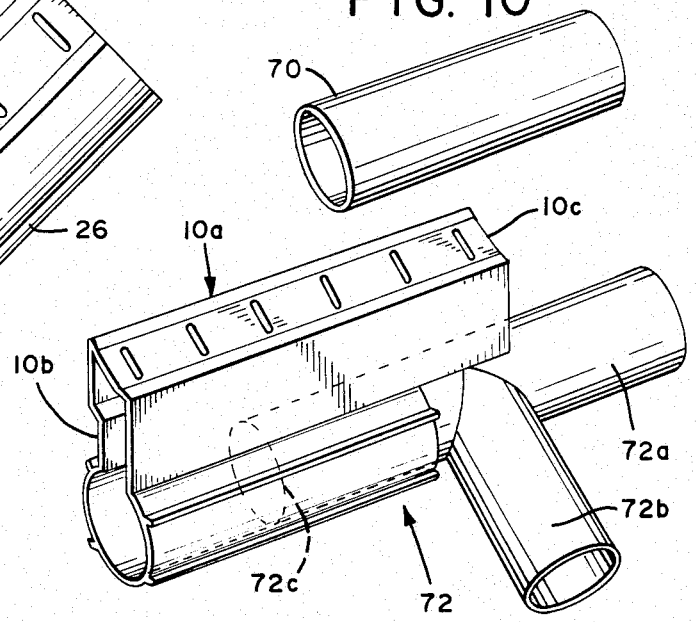
FIG. 11
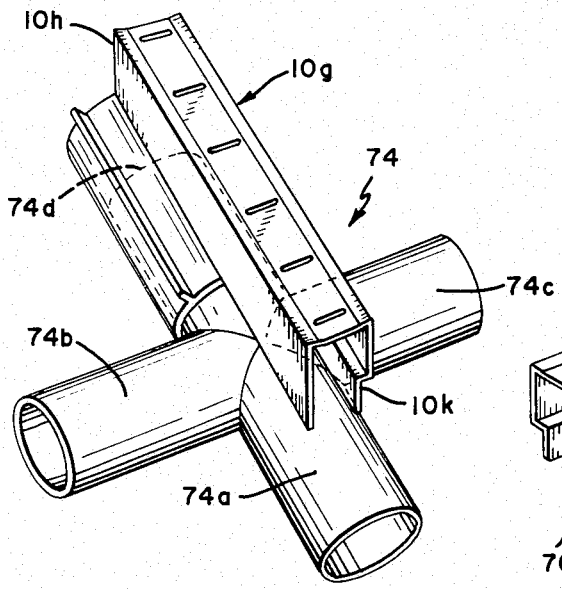
FIG. 12
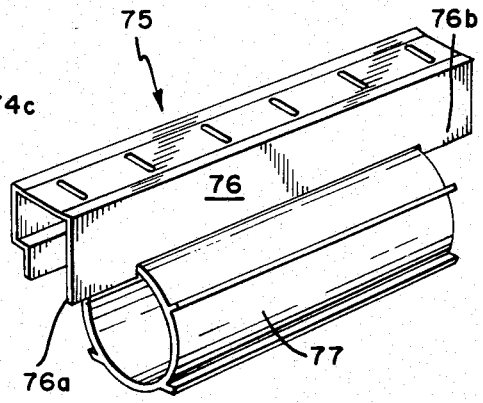
FIG. 13

MODULAR DRAIN SYSTEM

BACKGROUND OF THE INVENTION

1. Field of the Invention

The present invention relates to a drain construction and more particularly to a modular drain which may be substantially preassembled and the component parts welded or bonded off site and which requires minimal on site construction. The drain has particular utility in any construction which requires that surface waters be essentially completely drained away such as in a deck which surrounds a swimming pool, shopping mall, or any concrete or paved area. The drain also functions as an expansion joint to accommodate expansions and contractions in concrete slabs into which the drain is embedded and thereby avoids or controls undesirable cracking and/or other consequential damage resulting from contraction/expansion forces. The drain is adapted to be readily aligned and secured on the ground or substrate against dislocation while concrete is poured around the anchored drain, and may be attached to a conventional cylindrical drain pipe to conduct, from the site, water accumulated therein.

2. Description of the Prior Art

A variety of drains to carry away accumulation of water are known. In the vicinity of swimming pools and in enclosed shopping malls, for example, it is most important that water accumulations be removed and/or that seepage to the substrate beneath be prevented because of the disadvantages of moisture or dislocation damage that seepage can cause to the pool body itself or to decks and the surrounding structure such as by the freezing of seepage water.

It is also known, for example, as disclosed in U.S. Pat. No. 3,876,322, to provide a combined drain and expansion/contraction joint to absorb pressure and avoid the damage resulting from heating and cooling of concrete slabs or sections.

Heretofore, known drain structures of this kind have suffered from a number of disadvantages among which are included the relatively extensive amount of required on site installation time and the difficulty encountered in installing, aligning and holding the drain secure while it is being embedded in the concrete mass during the installation. A more particular disadvantage in known prior drain structures of this kind resides in the difficulty and time-consuming on site operations that are necessary to make a suitable water tight integrated system. In particular, in prior art drainage systems, the component pieces of the structure must be improvised and fitted in situ to connect the conduit means used to carry the accumulated water from the site. As a consequence, no system of this kind is known which affords an easily installable essentially water tight system. Another disadvantage of prior art attempts at drainage systems of this kind resides in the substantial improvisation required to hold and retain the drain in place, and in alignment, while the concrete is poured into place. Any dislocations or leaks are undesirable because moisture penetrating the underlying soil causes dampness problems and may cause the ramp or deck to swell and heave. A further requirement of drainage systems of this kind is that they be installed and fitted essentially flush against contiguous vertical walls, to drain away water that might otherwise accumulate and develop into an unsanitary condition such as in a corner or against a building wall.

It is thus apparent that a need exists for an improved, effective easy to install drain which permits ready assembly and welding or bonding of connections and which is provided in modular form that greatly facilitates on site installations.

SUMMARY OF THE INVENTION

The present invention provides an improved versatile drainage system whose components are provided in modular form and which can be designed and essentially prefabricated off site by selecting and solvent welding together the several modular components and then is readily installed and welded or bonded at the connections in situ with a minimum of labor to provide a dependable essentially water tight system. The top of the drain is offset to permit installation of the drain snugly against, and to remove water that would otherwise collect in corners near, a wall. An alignment color line is provided on one side of the drain modules to further facilitate the presassembly of the several component parts of the drainage system. Additionally, the drain of the invention functions to accommodate the effects of contraction and expansion of concrete slabs and cracks which may form contiguous to concrete structures in which the drain of the invention has been installed. The configuration of the drain of the invention overcomes the various disadvantages and limitations of conventional drain structures of the prior art which require substantial on site installation time and which often do not efficiently remove the accumulated water from the site.

The drain of the invention herein sometimes also referred to as a "conduit" comprises in essence a below ground longitudinal hollow member which, when embedded in concrete, has an exposed top side or surface with openings to admit therein accumulated water, said surface being essentially coplanar with the contiguous surface of the concrete in which the drain is installed. The modular drain element, in cross section, comprises a hollow upper part, with straight side walls, and a hollow lower cylindrical part, integrally formed with the upper part and whose transverse dimension is relatively larger than the transverse dimension of the upper part. The drain with the top surface only exposed is adapted to be secured on a substrate and embedded in concrete for such structures as decks, ramps and the like. Dimensioning of the upper part of the drain so that it has straight sides and is narrower in transverse dimension than the lower part permits optimum strength against downward forces and maximum flexibility whereby, because of the lower cylindrical shape, conventional tubing is readily adapted to be fitted and welded or bonded within the lower part of the drain. The straight sided top portion is formed so as to have a narrower transverse dimension at the bottom (where it connects to the lower cylindrical part) than at the top. Preferably, the plane of the top surface forms a right angle with at least one of the planar sides of the hollow top portion. In a preferred specific embodiment, the drain cross section is characterized as having a substantially rectangular hollow upper portion including: (i) a substantially horizontally top side (the upper surface of which is exposed when installed) (ii) a substantially vertical left side and (iii) a substantially vertical right side; and integrally formed at the bottom (sides) of this upper portion is a cylindrical lower portion having a transverse dimensional size, i.e., a diameter, substantially larger than the transverse dimension of the upper portion. The interior of the bottom cylindrical portion (at the top) is in open communication with the interior of the upper portion at its bottom side.

As noted, the upper portion is preferably integrally formed with said lower portion such as by being extruded from a suitable plastic composition and when rectangular in configuration, is relatively skewed in structure so that when the top side or top surface of the drain is positioned horizontally, one end of said upper portion is in vertical alignment with a side wall of said lower cylindrical portion. This allows the drain of the invention to be positioned so that this end of the upper portion abuts directly against a vertical wall or curbing and functions to remove any water collecting at such locations. Any water which passes through the openings in the top surface of the drain falls through the drain into the bottom cylindrical portion. A cylindrical pipe or tube of conventional kind is fitted and bonded in the bottom of the drain to carry away water accumulated in this cylindrical portion. Various fittings, such as universal T or universal cross connectors, common connector segments, nipple connectors, clean-out inserts, end caps, and the like are provided to facilitate on site installation. Clips to hold and align the drain are anchored on the ground and secured to the bottom of the drain.

The advantageous features of the invention will be more fully appreciated by reference to the figures of the drawing, a brief description of which follows, in conjunction with the following detailed description of the preferred embodiment of the invention.

BRIEF DESCRIPTION OF THE DRAWING

FIG. 4 is an elevational view of a 90 degree angular "inside" module of the drain of the invention.

FIG. 5 is a plan view of the 90 degree angle module of FIG. 4.

FIG. 6 is a plan view of a 45 degree angular inside module of the drain of the invention.

FIG. 7 is an elevational view of an "outside" 90 degree angle module of the drain of the invention.

FIG. 8 is a plan view of "outside" 90 degree angle module of FIG. 7.

FIG. 9 is a plan view of an "outside" 45 degree angle module of the drain of the invention.

FIG. 10 is a perspective view of a cylindrical section or nipple for insertion into the lower portion for connecting and solvent welding or bonding contiguous sections of the drain.

FIG. 11 is a perspective view of an assembled and bonded universal Tee member for connecting at intersections, segments of the drain for the system.

FIG. 12 is a perspective of an assembled and bonded universal cross module for connecting segments of the drain at intersecting points for the assembled system.

FIG. 13 is a modular common piece adapted to be used, to form a connection, in the assembled drain system, with either of the universal Tee or cross members of FIGS. 11 and 12, respectively.

DETAILED DESCRIPTION OF THE INVENTION

Figure 1:
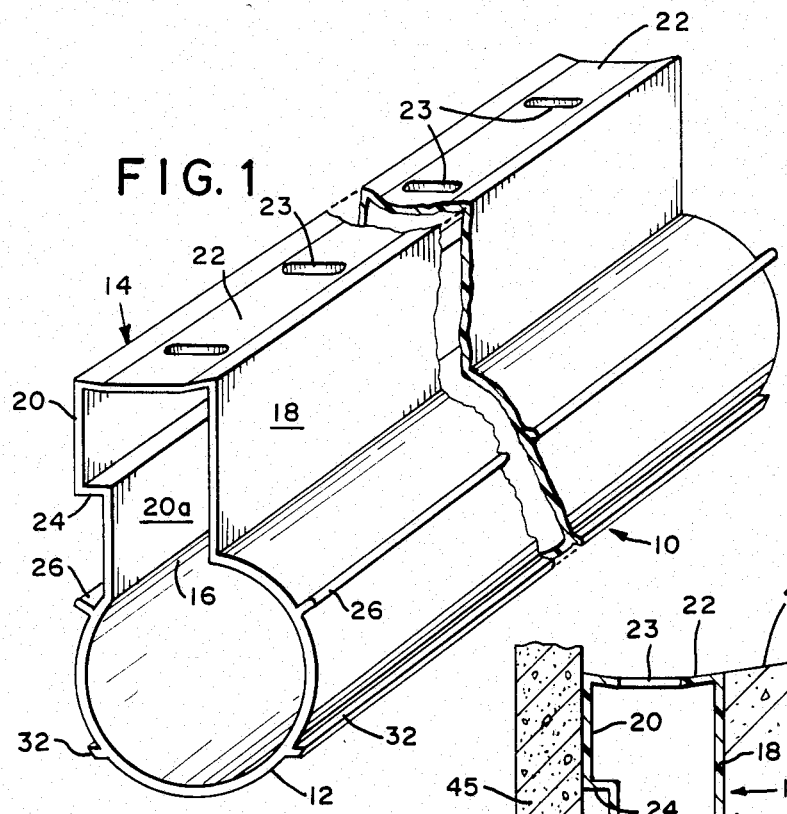
FIG. 1 is a perspective view of a typical straight section of the preferred form of the longitudinal drain or conduit of the invention.
Figure 18:
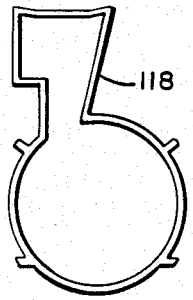
FIGS. 18, 19 and 20 illustrate various alternate end views for the longitudinal drain member.
Figure 19:
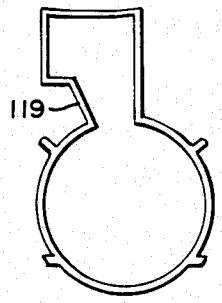
Figure 20:
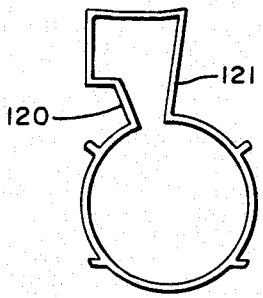

The basic component, i.e., the drain modular element used in the system is the drain or conduit 10 illustrated in FIG. 1. This element comprises a lower cylindrical portion 12 and an upper portion 14 which is polygonal in cross section (having its bottom side opening into the lower cylindrical portion) and which is offset with respect to the vertical center of the cylindrical portion 12. The polygonal portion 14 preferably is generally rectangular in configuration but it may take the form of other polygonal cross sections as illustrated, for example, the cross sections illustrated in FIGS. 18, 19 and 20 where the sides 118, 119, 120 and 121 are other than vertical.

Figure 2:
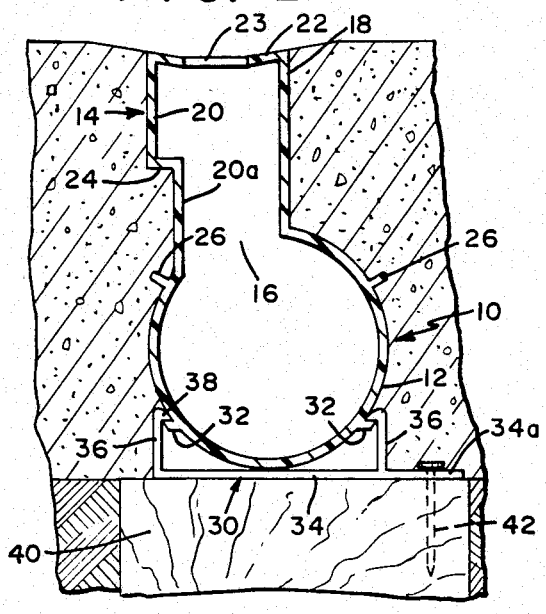
FIG. 2 is a cross sectional view of the drain, shown after installation, embedded in concrete.

As shown in FIG. 1, the polygonal upper portion 14 has a top side or surface 22 having a slight concave surface, a substantially vertical right wall 18 and a substantially vertical left wall 20 and has, in lieu of a bottom wall, the opening 16. This opening is common with the opening at the top of the cylindrical lower portion 12. The opening 16 in the cylindrical wall provides communication between the upper portion 14 and the lower cylindrical portion 12. The upper portion 14 is connected at the lower ends of the opposed vertical walls 18 and 20 to the cylindrical wall of lower portion 12 adjacent the opening 16. A plurality of spaced openings, or slots 23 through the top surface 22 of the polygonal upper part 14 provide communication between the exterior and interior of the drain conduit 10 for admitting water or other liquid to the interior of the drain 10; water so admitted settles in, and is carried away in the lower cylindrical portion 12 of the drain. The vertical wall 20 preferably is constructed with an offset 24 and then continues as lower wall 20*a*. The offset in cooperation with a longitudinal rib 26 of which a plurality may be provided, forms a suitable keyway to receive poured concrete to enhance the grip between the drain and the concrete, as best shown in FIG. 2. A pair of the ribs or extensions 26 appropriately positioned on the upper segment of the lower cylindrical part not only lock the drain in the concrete but also serve as barriers for preventing water seepage, downwardly along the walls of the drain.

Figure 16:
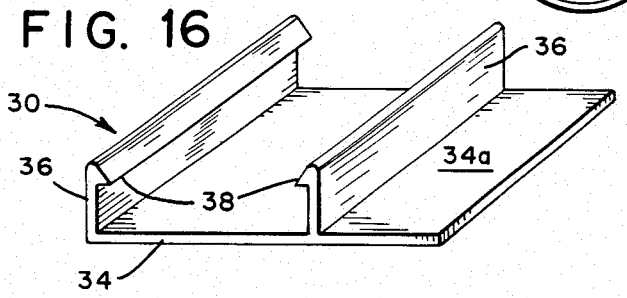
FIG. 16 is a perspective view of a securing clip for anchoring and/or aligning the drain or conduit member of the invention to the subsoil or other substrate.

The drain or conduit 10 may be advantageously anchored in position by attaching a securing clip 30 to opposed rails or extensions 32 which are integrally formed and extend longitudinally along the lower part of cylindrical portion 12. The clip 30 is best shown in FIG. 16 and comprises a base 34 with two spaced vertical prongs 36. Each prong is provided with a hook portion 38 for cooperating with the rails 32 as best seen in FIG. 2. The base 34 of the clip 30 extends beyond one of the vertical prongs to form an apron 34*a* for securing such as by a nail 42 to a stake 40 (FIG. 2) that is driven into the ground or is otherwise secured to the substrate. The preferred procedure for anchoring the drain conduit 10 is to first drive stakes 40 along the chosen path spaced a suitable distance such as two or three feet apart. Then snap clips 30 on the rails 32 of drain 10 by flexing the prongs 36 slightly to override the rails 36 and become hooked in place. The drain conduit 10 is then placed in position, the clips 30 are slid into position over the stakes 40 and nailed.

Figure 3:
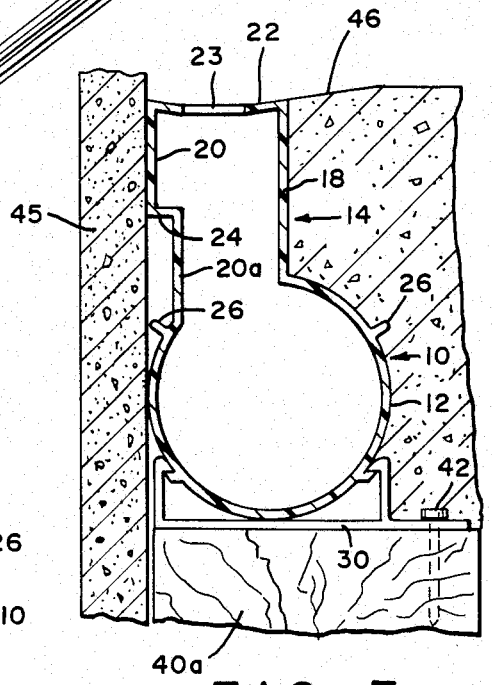
FIG. 3 is a cross sectional view of the drain abutting a vertical wall.

The drain of the invention, in which one edge of the top surface of the upper portion is in vertical alignment with one side wall of the lower (wider) cylindrical part, is adapted to abut a wall, curb, foundation, etc. and thereby remove any accumulations of water that tend to accumulate at those points, for example, against a building wall. As shown in FIG. 3, the side wall 20 of the upper part of drain 10 is positioned such as by the use of clips 30 and stakes 40*a* in abutting relationship to a vertical wall 45. The side wall of the lower, cylindrical part 12 also abuts the wall 45. By sloping the contiguous surface 46 near the drain slightly into the drain surface 22, even the smallest quantity of water tending to accumulate is drawn by the force of gravity into the drain openings 23.

The drain of the invention is provided with modular sections which are prefabricated and facilitate assembly of a broad range of system configurations. The basic modular components that permit the construction of practically any system are illustrated by FIGS. 4 through 13. When changing direction, the end of a straight section of the drain, which is normally supplied in convenient size, e.g. eight-foot lengths, may be attached to either a 90 degree or 45 degree module. Where the drain is to service an inside 90 degree or 45 degree "inside" corner, drain modules 50 and 55 of FIG. 5 and FIG. 6, respectively, are employed. When the drain is to service 90 degree and 45 degree outside structures, the modules 60 and 65 of FIG. 8 and FIG. 9, respectively are used.

When interconnecting straight sections of the drain 10, a plain cylindrical nipple 70, of the kind shown in FIG. 10, is inserted and bonded within the lower cylindrical part 12 of the drain. Any suitable bonding or welding of the parts can be used. When PVC (polyvinyl chloride) drain components and piping are used, conventional bonding (solvent welding) compositions are applied to the parts to be connected and the parts are joined and held for the brief period required for the parts to adhere firmly.

Where a Tee or cross connection is needed for the drain system, the modules 72 and 74 of FIG. 11 and FIG. 12 respectively are employed. These items are supplied as preassembled and bonded modules. In FIG. 11, a segment 10*a* of the drain is mounted on, and bonded to, the left end 72C (shown in phantom) of the Tee member 72. The drain element of the invention can be connected at the right end 72*a* and front end 72*b* of this Tee.

In FIG. 12, a segment 10*g* of the drain is mounted on and bonded to 74*d*, shown in phantom, one of the four arms, 74*a*, 74*b*, 74*c* and 74*d* of the cylindrical cross member 74. As shown, the drain portions 10*a* and 10*g* of the modules of FIG. 11 and FIG. 12, respectively, are extended at one end, 10*b* and 10*h*, respectively, receive and be bonded to a cylindrical conduit or a nipple 70 in assembling the system. The other end of the universal Tee and universal cross drain portions 10*a* and 10*g*, respectively, are provided with an under cut at 10*c* and 10*k*, respectively, to mate with the common piece illustrated in FIG. 13.

The common piece of FIG. 13 is essentially a segment of the drain 10 of FIG. 1 with an undercut formed at each end of the piece to permit it to interfit with the universal modules of FIG. 11 and FIG. 12. As seen by reference to FIG. 13, the module 75 comprises the polygonal upper part 76 and the cylindrical lower part 77. The upper polygonal part 76 extends, i.e. overhangs, at each end 76*a* and 76*b* the cylindrical lower part. This overhang is designed to meet the upper portion of the universal modules of FIG. 11 and FIG. 12 when the lower cylindrical portion of the common modular part 75 of FIG. 13 is fitted on a cylindrical arm, i.e. arm 72*a* and 72*b* of FIG. 11 and arms 74*a*, 74*b* or 74*c* of FIG. 12.

Figure 14:
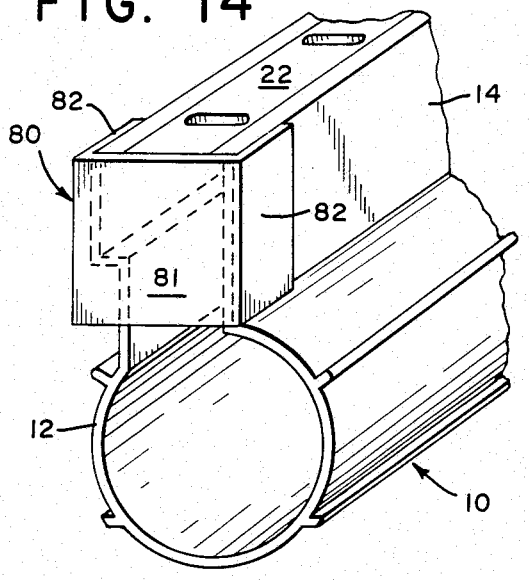
FIG. 14 is a perspective view of a fragmentary portion of an end of a straight section with a top end closure cap, bonded to the upper portion of the drain.
Figure 15:
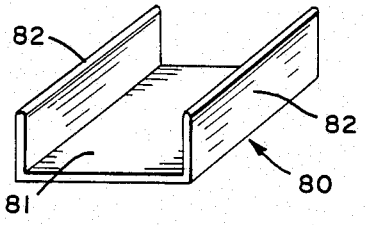
FIG. 15 is a perspective view of the end closure cap for the upper portion of the drain.

The end of the upper portion 14 of the drain conduit 10 can be closed by attaching a top end cap 80 as shown in FIG. 15 to the end of a drain section 10 as best shown in FIG. 14. The cap 80 comprises a base portion 81 that extends across the open end of the drain 10 and projecting side pieces 82 that fit on the wall of the upper portion 14 of the drain or conduit 10. This end cap 80 is also secured such as by solvent welding.

Water collected in the interior of the drain is suitably conducted away from the site by a conventional commercially available piping and fittings or plastic tubing used for this purpose and reading connected to the drain of the invention by inserting such tubing or fitting within the lower cylindrical portion of the drain and bonding the parts such as by solvent welding.

Figure 17:
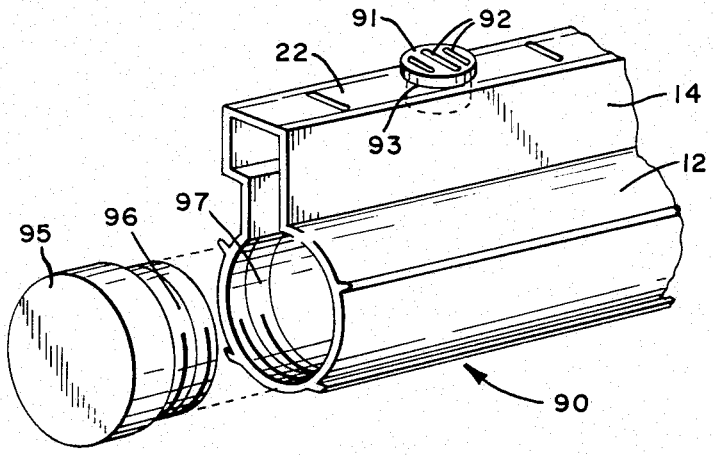
FIG. 17 is a perspective view of a segment of a straight section of the drain of the invention illustrating the addition of a clean-out element for which a hole has been drilled and cap inserted in the top drain surface and illustrating, also, an end cap in the lower cylindrical part of the drain.

The longitudinal hollow drain of the invention may comprise an extrudate of, i.e. may be extruded from, any of a variety of suitable compositions preferably plastic or resins but may include metals, such as aluminum. Suitable resinous compositions include various thermoplastic (as well as thermosetting compositions) such as polyvinyl chloride, various polyolefins e.g. polyethylene or propylene, polycarbonates, nylon, polyesters, polymethylmethacrylate, and the like, which are known by those skilled in the art as resins which possess suitable properties for an application of this kind. Although the drain construction of the invention is designed to be substantially free of internal clogging, should a clean-out capability be desired, the drain is adaptable to accomodate a surface clean-out hole and/or cylindrical end clean-out openings as shown in FIG. 17.

To provide the surface clean-out access opening, a hole 93 of sufficient diameter, such as to receive a standard garden hose, for example, is drilled in the surface 22 (FIG. 17) and a plastic plug 91 which may contain openings 92 therein is secured therein as by a snap (spring) fit. An end access opening may also be suitably provided such as by inserting a threaded nipple 96 (FIG. 17) in the end 97 of the lower cylindrical part and threading thereon an end cap 95.

It will be appreciated that the drain of the invention advantageously functions also as an expansion joint that comprises a resilient means for absorbing the expansion and contraction of the cured concrete. Furthermore, the top surface 22 of the drain provides an unobtrusive and substantially smooth surface connection between contiguous sections or slabs of the concrete and functions to absorb stresses caused by expansion and contraction of the concrete to inhibit damage to the surrounding structure, e.g. a swimming pool deck.

The invention has been illustrated and described in considerable detail so that the configuration and advantages of the improved bonded joint may be readily appreciated by those skilled in the art. It will be understood, however, that various changes may be made in such details without departing from the spirit or scope of the invention.

What I claim is:

1. A below ground hollow longitudinal drain and expansion joint element adapted to be secured in the ground and embedded in concrete, said drain element receiving drainage water through the top surface and comprising:

(a) a polygonal hollow upper portion having a first transverse dimension including: (i) a substantially horizontal top surface, (ii) a left side wall and (iii) a right side wall; and (b) a substantially cylindrical lower portion having a second transverse dimension which is uniform in diameter throughout and which is substantially larger than the said first transverse dimension of the upper portion, the interior at the top of said lower portion being in open communication with the interior of and at the bottom of said upper portion, said upper portion being integrally formed with said lower portion and being relatively offset in structure so that when said top surface is positioned horizontally, one end of said top surface is in vertical alignment with one side wall extremity of said lower cylindrical portion, said longitudinal element being sufficiently resilient to absorb stresses caused by expansion and contraction of concrete in which said element is installed.

2. A below ground hollow longitudinal drain and expansion joint element adapted to be secured in the ground and embedded in concrete and for receiving drainage water through the top surface, comprising:

(a) a polygonal hollow upper portion having an opening at the bottom and including: (i) a substantially horizontal top surface, (ii) a left side wall and (iii) a right side wall, at least one of said left and right side walls forming a right angle with said top surface; and (b) a substantially cylindrical lower portion have a transverse dimension which is uniform in diameter throughout and is substantially larger than the transverse dimension of the upper portion and whose interior at the top is in open communication with the interior of said upper portion through said opening;

said upper portion being integrally formed with said lower portion and being relatively offset in structure so that when said top surface is positioned horizontally, one end of said top surface is in vertical alignment with one side wall extremity of said lower cylindrical portion, said longitudinal element being sufficiently resilient to absorb stresses caused by expansion and contraction of the concrete in which said element is installed.

3. The drain of claim 2 wherein the cylindrical lower portion is provided with an outer integrally formed indentation or channel adapted to receive concrete therein.

4. The drain of claim 2 wherein the cylindrical lower portion is provided with integrally formed projections extending outwardly of said cylindrical portion to aid in anchoring said drain to the underlying substrate.

5. The drain of claim 4 wherein at least one of said projections is contiguous to the bottom of the lower cylindrical portion to engage a detachable ground securing clip.

6. The drain of claim 2 comprising an extrudate of a synthetic resinous composition.

7. The drain of claim 6 wherein said composition is polyvinyl chloride.

8. The drain of claim 2 which is in the form of an interconnectable modular section having a 45 degree angle configuration in the horizontal plane.

9. The drain of claim 2 which is in the form of an interconnectable modular section having a rectangular configuration in the horizontal plane.

10. A drainage system comprised of the drain of claim 2 in combination with closure clips secured on ends of said upper portions.

11. A modular adapter comprising a drain in accordance with claim 2 in combination with, and bonded to, a cross tubular connection.

12. A modular adapter comprising a drain in accordance with claim 2 in combination with, and bonded to, a Tee tubular connector.

13. A modular adapter comprising a drain in accordance with claim 2 wherein said drain is formed with an undercut at each end of said lower cylindrical portion.

14. The drain of claim 2 provided with a circular clean-out opening in the horizontal top side.

15. The drain of claim 2 provided with an end closure cap in said lower cylindrical portion.

* * * * *